US009347261B2

(12) United States Patent
Blair et al.

(10) Patent No.: US 9,347,261 B2
(45) Date of Patent: May 24, 2016

(54) ADJUSTMENT MECHANISMS FOR SHADES

(71) Applicant: LUTRON ELECTRONICS CO., INC., Coopersburg, PA (US)

(72) Inventors: Edward J. Blair, Telford, PA (US); Samuel F. Chambers, Gwynedd Valley, PA (US); Stephen Lundy, Coopersburg, PA (US); Nathan Butler, Telford, PA (US)

(73) Assignee: LUTRON ELECTRONICS CO., INC., Coopersburg, PA (US)

( * ) Notice: Subject to any disclaimer, the term of this patent is extended or adjusted under 35 U.S.C. 154(b) by 0 days.

(21) Appl. No.: 14/450,125

(22) Filed: Aug. 1, 2014

(65) Prior Publication Data

US 2015/0034260 A1 Feb. 5, 2015

Related U.S. Application Data

(60) Provisional application No. 61/861,692, filed on Aug. 2, 2013, provisional application No. 61/880,338, filed on Sep. 20, 2013.

(51) Int. Cl.
*E06B 9/42* (2006.01)
*E06B 9/68* (2006.01)
(Continued)

(52) U.S. Cl.
CPC ... *E06B 9/42* (2013.01); *E06B 9/24* (2013.01); *E06B 9/34* (2013.01); *E06B 9/68* (2013.01); *E06B 2009/2435* (2013.01)

(58) Field of Classification Search
CPC ..... A47H 1/12; A47H 1/122; A47H 1/124; E06B 9/50; E06B 2009/2435; E06B 9/42; E06B 9/34; E06B 9/24; E06B 9/68
USPC ..... 160/121.1, 323.1; 248/270, 269, 271
See application file for complete search history.

(56) References Cited

U.S. PATENT DOCUMENTS 2,013,500 A * 9/1935 O'Connor ..... 248/269
3,809,143 A 5/1974 Ipekgil
(Continued)

FOREIGN PATENT DOCUMENTS

EP 886030 A2 12/1998
EP 972906 A1 1/2000
(Continued)

OTHER PUBLICATIONS

Elegazzo, "Grand Elegance Power Blinds Product Literature", 2008, 8 pages.
(Continued)

*Primary Examiner* — Blair M Johnson
(74) *Attorney, Agent, or Firm* — Condo Roccia Koptiw LLP

(57) ABSTRACT

A motorized shading system may include a housing, a roller tube, a sheer shade material, and a bottom bar. The shading system may be configured such that opposed ends of the roller tube are adjustable relative to the housing. The shading system may include first and second sliding members that couple opposed ends of the roller tube to the housing and that are configured to translate along first and second rails defined by the housing. The bottom bar may define a cross-sectional profile such that when the shade material is in a closed position, a first lower most edge of the bottom bar is spaced from the roller tube by a first distance, and when the shade material is in a view position, a second lower most edge of the bottom bar is spaced from the roller tube by a second distance that is substantially equal to the first distance.

14 Claims, 6 Drawing Sheets

(51) Int. Cl.
*E06B 9/34* (2006.01)
*E06B 9/24* (2006.01)

(56) References Cited

U.S. PATENT DOCUMENTS

| | | | | |
|---|---|---|---|---|
| 4,914,360 | A | 4/1990 | Hsieh et al. | |
| 5,391,967 | A | 2/1995 | Domel et al. | |
| 5,413,161 | A | 5/1995 | Corazzini | |
| 5,663,621 | A | 9/1997 | Popat | |
| 5,760,558 | A | 6/1998 | Popat | |
| 5,793,174 | A | 8/1998 | Kovach et al. | |
| 5,883,480 | A | 3/1999 | Domel et al. | |
| 5,990,646 | A | 11/1999 | Kovach et al. | |
| 6,057,658 | A | 5/2000 | Kovach et al. | |
| 6,100,659 | A | 8/2000 | Will et al. | |
| 6,181,089 | B1 | 1/2001 | Kovach et al. | |
| 6,196,508 | B1 | 3/2001 | Nijs | |
| 6,259,218 | B1 | 7/2001 | Kovach et al. | |
| 6,299,115 | B1 | 10/2001 | Kovach et al. | |
| 6,369,530 | B2 | 4/2002 | Kovach et al. | |
| 6,688,369 | B2 | 2/2004 | Colson et al. | |
| 6,812,662 | B1 | 11/2004 | Walker | |
| 7,059,378 | B2 | 6/2006 | Colson et al. | |
| 7,281,565 | B2 | 10/2007 | Carmen, Jr. et al. | |
| 7,315,146 | B2 | 1/2008 | Bejean | |
| 7,401,634 | B2 | 7/2008 | Kovach et al. | |
| 7,466,090 | B2 | 12/2008 | Meewis et al. | |
| 7,537,040 | B2 | 5/2009 | Carmen, Jr. et al. | |
| 7,635,018 | B2 | 12/2009 | Carmen, Jr. et al. | |
| 7,673,667 | B2 | 3/2010 | Domel et al. | |
| 7,719,215 | B2 | 5/2010 | Meewis et al. | |
| 7,737,653 | B2 | 6/2010 | Carmen, Jr. et al. | |
| 7,839,109 | B2 | 11/2010 | Carmen, Jr. et al. | |
| 8,723,466 | B2 | 5/2014 | Chambers et al. | |
| 2002/0189771 | A1* | 12/2002 | Colson et al. | 160/323.1 |
| 2004/0154755 | A1 | 8/2004 | Judkins | |
| 2005/0183835 | A1* | 8/2005 | Nien | 160/321 |
| 2005/0194104 | A1 | 9/2005 | Nien | |
| 2005/0199350 | A1 | 9/2005 | Lin | |
| 2007/0079943 | A1* | 4/2007 | Smith et al. | 160/121.1 |
| 2008/0262637 | A1 | 10/2008 | Dorrough | |
| 2009/0152422 | A1* | 6/2009 | Ng et al. | 248/265 |
| 2009/0256021 | A1 | 10/2009 | Dorrough | |
| 2011/0240232 | A1 | 10/2011 | Kluck | |
| 2011/0251720 | A1 | 10/2011 | Neuman | |
| 2012/0048481 | A1 | 3/2012 | Feldstein et al. | |
| 2012/0048490 | A1 | 3/2012 | Feldstein et al. | |
| 2012/0050596 | A1 | 3/2012 | Feldstein et al. | |
| 2012/0053729 | A1 | 3/2012 | Feldstein et al. | |
| 2012/0053731 | A1 | 3/2012 | Feldstein et al. | |
| 2012/0073765 | A1 | 3/2012 | Hontz et al. | |
| 2012/0125543 | A1 | 5/2012 | Chambers et al. | |
| 2012/0222828 | A1 | 9/2012 | Kwak | |
| 2013/0068904 | A1* | 3/2013 | Wills et al. | 248/207 |
| 2014/0262069 | A1* | 9/2014 | Drew et al. | 160/120 |
| 2015/0034257 | A1* | 2/2015 | Blair et al. | 160/121.1 |
| 2015/0034260 | A1* | 2/2015 | Blair et al. | 160/310 |

FOREIGN PATENT DOCUMENTS

| | | | |
|---|---|---|---|
| EP | 1496190 | A1 | 1/2005 |
| EP | 1811122 | A2 | 7/2007 |
| EP | 2256284 | A2 | 12/2010 |
| EP | 2476859 | A2 | 7/2012 |
| GB | 2319278 | A | 5/1998 |

OTHER PUBLICATIONS

Lee et al., "Integrated Performance of an Automated Venetian Blind/Electric Lighting System in a Full-Scale Private Office", Proceedings of the ASHRAE/DOE/BTECC Conference, LBNL-41443, Lawrence Berkeley National Laboratory, Berkeley, California, Sep. 1998, 26 pages.

Lee et al., "Low-Cost Networking for Dynamic Window Systems", Energy and Buildings 36, LBNL-52198, Lawrence Berkeley National Laboratory, Berkeley, California, 2004, pp. 1-13 pages.

Lutron, "For Your Information-Controlling Hunter Douglas Silhouette Shades from HomeWorks Master Keypads", Lutron Electronics Co., Inc., Application Note # 30, 1997, 2 pages.

Lutron Electronics Co., Inc., "Lutron® Roller 100™/ Roller 150™ Wall Mount Chassis", Installation Guide, Dec. 2012, 2 pages.

Sivoia, "Coupled Shade System with End Motor", Lutron Electronics Co., Inc., Motorized Shade Systems, Installation & Operating Instructions, Coupled Pin Kit, 2003, 8 pages.

European Patent Office, International Search Report and Written Opinion for International Patent Application No. PCT/US2011/051906, Apr. 18, 2012, 24 pages.

* cited by examiner

ADJUSTMENT MECHANISMS FOR SHADES

CROSS-REFERENCE TO RELATED APPLICATIONS

This application claims priority to U.S. provisional patent application No. 61/861,692, filed Aug. 2, 2013, and to U.S. provisional patent application No. 61/880,338, filed Sep. 20, 2013. U.S. provisional patent application Nos. 61/861,692 and 61/880,338 are incorporated herein by reference in their entireties.

BACKGROUND

Sheer shading systems, such as horizontal sheer blinds or soft sheer shades, may include sheer shade materials that include first and second spaced apart, vertically extending sheer fabrics and a plurality of vertically spaced, transversely extending vanes that are attached between the first and second sheer fabrics. The sheer fabrics are often made of a translucent material and may be in the form of woven or knitted fabrics, non-woven fabrics, or sheets of plastic material. The vanes are often made of an opaque material.

In such a sheer shade system, an upper end of the shade material may be attached to a roller tube, and an opposed lower end of the shade material may be attached to a weighted bottom bar, such that the shade material hangs, for instance in front of a window. Rotation of the roller tube may raise or lower the shade material between respective open and closed positions.

When the shade material is in the closed position, further rotation of the roller tube may cause the vanes to tilt relative to the sheer fabrics, to thereby position the shade material in a view position. The shade material may have an open position wherein the shade material is not covering the window, a closed position wherein the shade material is covering the window such that visualization through the shade is impeded, and a view position wherein the shade material is covering the window such that visualization through the shade material is permitted.

When a sheer shading system is mounted over a window, a gap (e.g., a light gap) may be defined between the bottom bar and the window sill when the sheer shade material is in the closed position and/or when the sheer shade material is in the view position. This may occur, for example, if the bottom bar is not level relative to the window sill. The presence of such a light gap may be aesthetically unpleasant. Furthermore, even if a light gap is not present when the sheer shade material is in the closed or view positions, a light gap may temporarily exist when the bottom bar rotates during movement of the sheer shade material between the closed position and the view position.

SUMMARY

As described herein, a motorized sheer shading system may include a housing, a roller tube that is rotatably mounted to the housing, a sheer shade material that is windingly attached to the roller tube, and a motor that is operably coupled to the roller tube such that rotation of the roller tube by the motor causes the sheer shade material to move between an open position wherein the sheer shade material is wound about the roller tube, a closed position wherein the sheer shade material covers an opening and visualization through the sheer shade material is impeded, and a view position wherein the sheer shade material covers the opening and visualization through the sheer shade material is permitted.

The sheer shade material may include a first sheer fabric, a second sheer fabric that is spaced from the first sheer fabric, and a plurality of vanes that are pivotally attached to the first and second sheer fabrics. The plurality of vanes may tilt relative to the first and second sheer fabrics when the sheer shade material moves between the closed position and the view position. The motorized sheer shading system may include a bottom bar that is attached to a lower end of the sheer shade material.

The motorized sheer shading system may be configured such that opposed ends of the roller tube are adjustable relative to corresponding ends of the housing. In this regard, the roller tube, and thus the sheer shade material and the bottom bar, may be adjusted relative to a structure, such as the sill of a window. This may enable leveling of the bottom bar relative to the structure, and or the reduction of a gap that may be visible between the bottom bar and the structure, for instance when the sheer shade material is in the closed position and/or when the sheer shade material is in the view position.

The motorized sheer shading system may include first and second adjustment mechanisms that couple the first and second ends of the roller tube, respectively, to the housing. The housing may include first and second housing brackets that are attached to first and second ends of the housing, respectively. The first and second housing brackets may be configured to operably attach to the first and second adjustment members, respectively. The first and second housing brackets may include respective first and second rails along which the first and second adjustment members may translate.

The first and second adjustment mechanisms may include respective first and second sliding members that are configured to translate along the first and second rails, respectively, of the first and second housing brackets. Each sliding member may define a guide channel that is configured to receive a corresponding rail. The first and second sliding members may each define a pair of protrusions that are configured to be received in a complementary pair of retention member recesses defined by a corresponding one of the first and second housing brackets.

The first and second adjustment mechanisms may each include an activation member comprising a threaded shaft that is configured to engage with complementary threads defined by a corresponding one of the first and second sliding members. Rotation of an activation member causes a corresponding sliding member to translate along the rail of a corresponding one of the first and second housing brackets. The first and second housing brackets may each be configured to translatably fix the activation member of a corresponding one of the first and second adjustment mechanisms.

The bottom bar of the motorized sheer shading system may define a cross-sectional profile such that when the sheer shade material is in the closed position, the bottom bar assumes a first position wherein a first lower most edge of the bottom bar is spaced from the roller tube by a first distance, and such that when the sheer shade material is in the view position, the bottom bar assumes a second position wherein a second lower most edge of the bottom bar is spaced from the roller tube by a second distance that is substantially equal to the first distance.

DETAILED DESCRIPTION

Figure 1C:
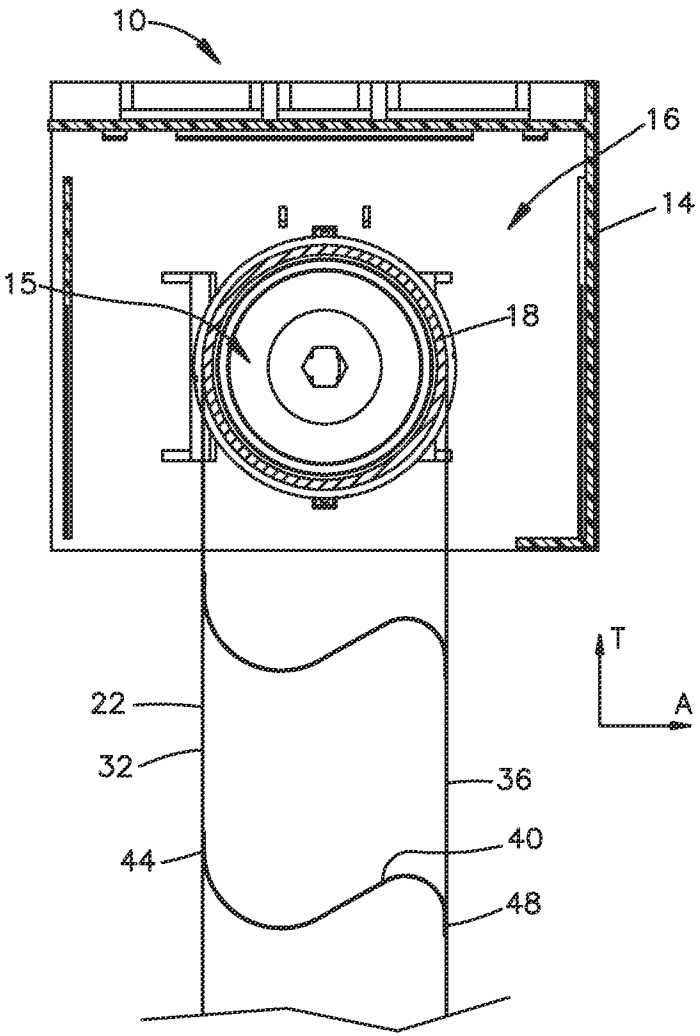
FIG. 1C depicts a cross-section of the example motorized sheer shading system depicted in FIG. 1A.
Figure 1A:
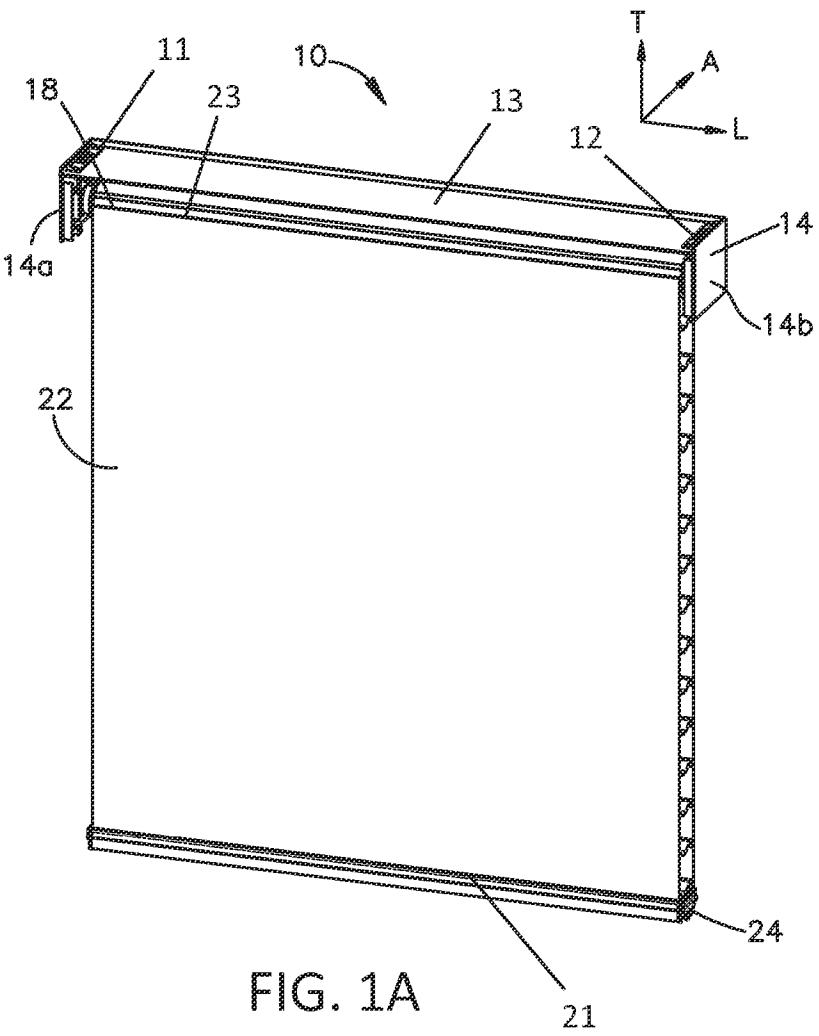
FIG. 1A is a perspective view of an example motorized sheer shading system that includes a housing, a roller tube that is rotatably mounted to the housing, a sheer shade material that is windingly attached to the roller tube, a bottom bar that is attached to a lower end of the sheer shade material, and a motor that is configured to move the sheer shade material between an open position, a closed position, and a view position.
Figure 1B:
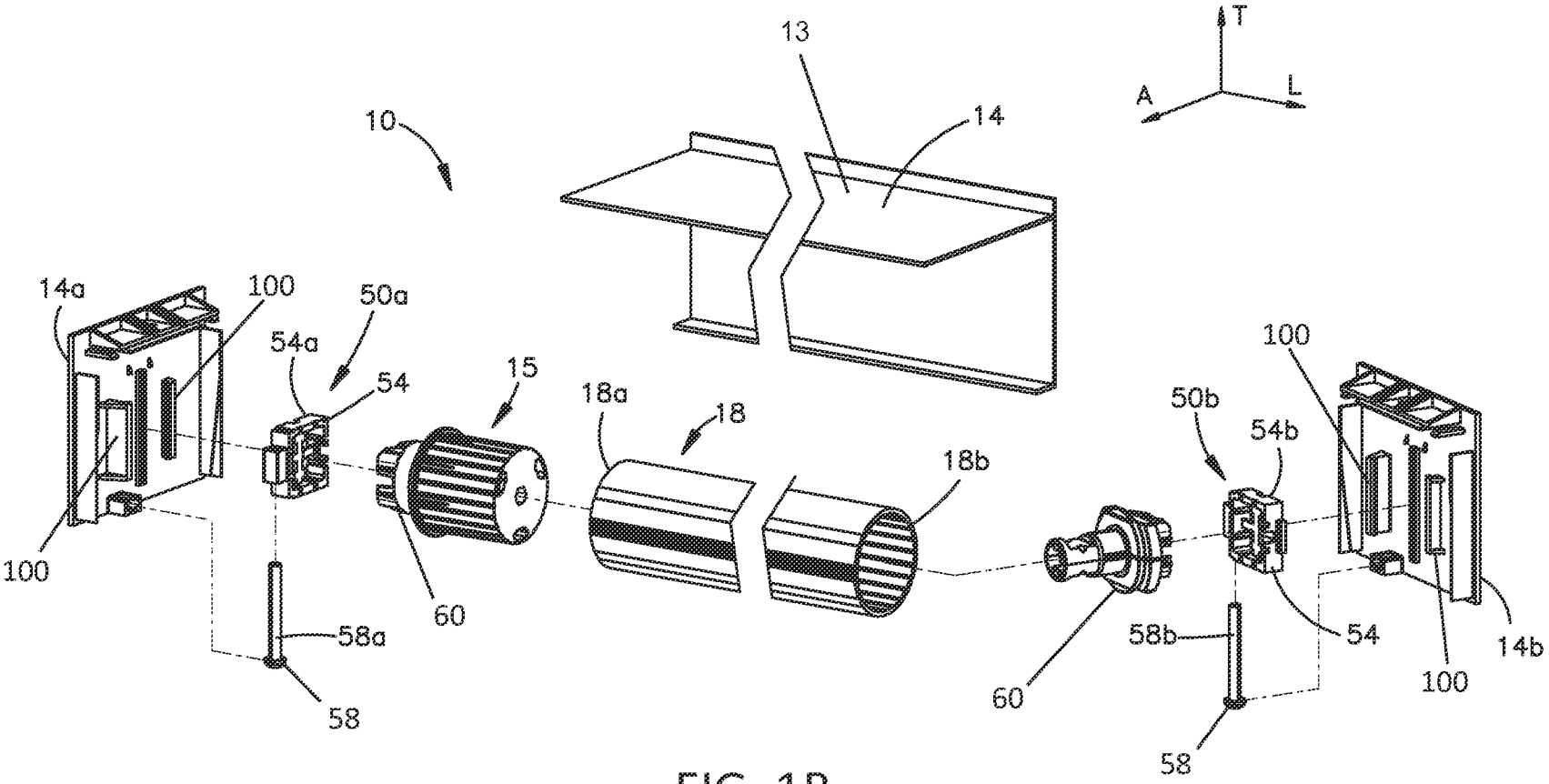
FIG. 1B is an exploded view depicting components of the example motorized sheer shading system depicted in FIG. 1A.

FIGS. 1A-1C depict an example motorized shade system. As shown, the motorized shade system is configured as a motorized sheer shading system 10. The illustrated motorized sheer shading system 10 includes a housing 14 (e.g., a pocket or a headrail) that is configured to be coupled to or otherwise mounted adjacent an opening, such as a window or other structure. The housing 14 includes a top rail 13 that may be configured to be mounted to structure, a first housing bracket 14*a*, and a second housing bracket 14*b*. The first housing bracket 14*a* may be configured to be attached to a first end 11 of the top rail 13, and the second housing bracket 14*b* may be configured to be attached to an opposed second end 12 of the top rail 13. In accordance with the illustrated orientation of the motorized sheer shading system 10, the housing 14 is elongate along a longitudinal direction L that may be referred to as a first direction (e.g., between the first and second ends 11, 12). The top rail 13 and the first and second housing brackets 14*a*, 14*b* may define a cavity 16 of the housing 14. The components of the housing 14 may be made of any suitable material, such as plastic or metal. It should be appreciated that the components of the housing 14 may be made from any material, or from any combination of materials. It should further be appreciated that the housing 14 is not limited to the illustrated configuration of components. For example, the first and second housing brackets 14*a*, 14*b* and the top rail 13 may be monolithic.

The motorized sheer shading system 10 may further include a roller tube 18 that is rotatably mounted (e.g., rotatably supported) within the cavity 16 of the housing 14. For example, the roller tube 18 may be supported by the first and second housing brackets 14*a*, 14*b*. The motorized sheer shading system 10 may further include a covering material, for example a sheer shade material 22, that is windingly attached to the roller tube 18, such that rotation of the roller tube 18 causes the sheer shade material 22 to wind or unwind from the roller tube 18, and thereby to move along a transverse direction T that extends normal to the longitudinal direction L, and that may be referred to as a second direction. The sheer shade material 22 may move along the transverse direction T between an open position wherein the sheer shade material 22 is substantially wound about the roller tube 18, a closed position wherein the sheer shade material 22 substantially covers the opening and visualization through the sheer shade material 22 is impeded, and a view position wherein the sheer shade material substantially covers the opening and visualization through the sheer shade material 22 is permitted.

As shown, the sheer shade material 22 defines a lower end 21 that may be referred to as a first end, and an opposed upper end 23 that may be referred to as a second end. The motorized sheer shading system 10 may include a bottom bar 24 that is attached to the lower end 21 of the sheer shade material 22. The bottom bar 24 may be configured, for instance weighted, to cause the sheer shade material 22 to hang vertically. The upper end 23 of the sheer shade material 22 may be coupled to (e.g., windingly attached to) the roller tube 18, such that rotation of the roller tube 18 causes the bottom bar 24 to move toward or away from the housing 14.

As shown in FIG. 1C, the sheer shade material 22 may include a first sheer fabric 32 that extends vertically (e.g., hangs) from a first location on the roller tube 18, a second sheer fabric 36 that extends vertically (e.g., hangs) from a second location on the roller tube 18 and that is laterally spaced from the first sheer fabric 32, and a plurality of vertically spaced vanes 40 that extend between the first and second sheer fabrics 32, 36. As shown, the first and second sheer fabrics 32, 36 extend horizontally along the longitudinal direction L and vertically along the transverse direction T, and are spaced from each other along a lateral direction A that extends normal to the transverse direction T and to the longitudinal direction L, and that may be referred to as a third direction.

The first and second sheer fabrics 32, 36 may be made of a translucent material, such that visualization through the first and second sheer fabrics 32, 36 may be permitted. As shown, the vanes 40 are vertically spaced from each other along the transverse direction T, for example when the sheer shade material 22 is in the view position. Each vane 40 defines a first end 44 and an opposed second end 48. As shown, the first end 44 of each vane 40 may be attached (e.g., pivotally attached) to the first sheer fabric 32, and the second end 48 of each vane 40 may be attached (e.g., pivotally attached) to the second sheer fabric 36. The vanes 40 may be made of an opaque material, such that visualization through the vanes 40 is impeded or otherwise not permitted. For example, the vanes 40 may be made of blackout and/or light filtering materials. It should be appreciated, however, that in some embodiments the motorized shade system may include other types of shades including roller shades, transitional shades (e.g., shades that have alternating opaque and transparent portions), etc.

Figure 5B:
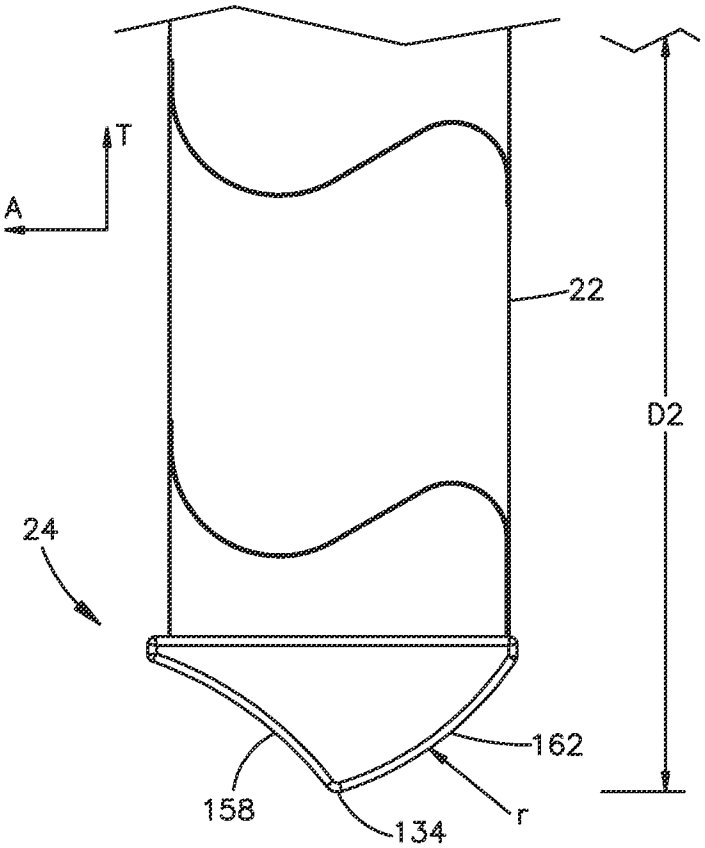
FIG. 5B is a side elevation view of the bottom bar of the example motorized sheer shading system depicted in FIG. 1A, with the bottom bar in a second position.
Figure 5A:
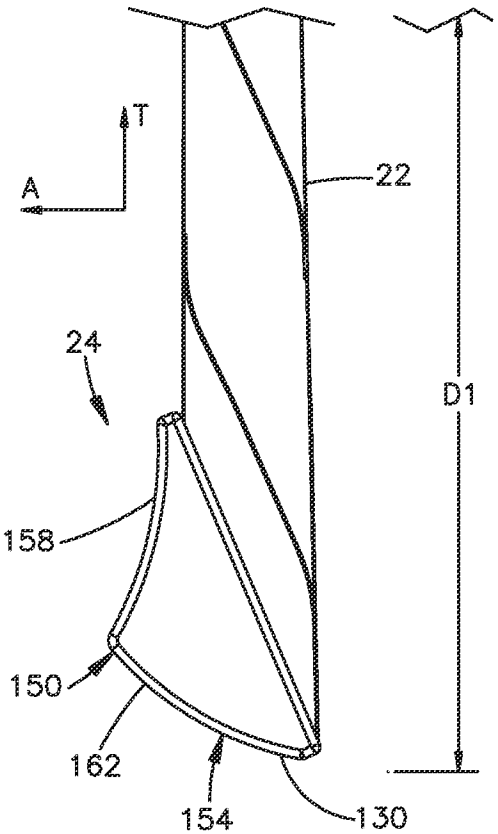
FIG. 5A is a side elevation view of the bottom bar of the example motorized sheer shading system depicted in FIG. 1A, with the bottom bar in a first position.

When the sheer shade material 22 is in the closed position (e.g., as shown in FIG. 5A), the plurality of vanes 40 may be oriented substantially parallel to the first and second sheer fabrics 32, 36 (e.g., oriented vertically relative to the first and second sheer fabrics 32, 36), such that visualization through the sheer shade material 22 may be impeded by the vanes 40.

For example, when the sheer shade material 22 is in the closed position, corresponding opposed ends of the plurality of vanes 40 may align with and/or overlap each other. To illustrate, when the sheer shade material 22 is in the closed position, the second end 48 of a first vane 40 may be substantially aligned with (e.g., along the transverse direction T and/or the lateral direction A) and/or may overlap a corresponding portion of the first end 44 of a second vane 40 that is immediately adjacent (e.g., above or below) the first vane 40, such that visualization between adjacent vanes 40 is impeded.

As the sheer shade material 22 moves from the closed position to the view position, the plurality of vanes 40 may angularly tilt (e.g., pivot) relative to the first and second sheer fabrics 32, 36, such that the corresponding opposed ends of adjacent vanes 40 move away from each other along the transverse direction T. When the sheer shade material 22 is in the view position (e.g., as shown in FIG. 5B), the plurality of vanes 40 may be oriented substantially normal to the first and second sheer fabrics 32, 36 (e.g., oriented horizontally relative to the first and second sheer fabrics 32, 36), such that visualization through the sheer shade material 22 may be permitted (e.g., between the vanes 40).

As shown in FIG. 1B, the motorized sheer shading system 10 may further include a drive system such as a motor drive unit 15 that is mounted inside the housing 14 and at least partially within the roller tube 18. The motor drive unit 15 may be configured to allow for control of the rotation of the roller tube 18 by a user of the motorized sheer shading system 10, so that the user may move the sheer shade material 22 to a desired position. The motor drive unit 15 may include sensors that monitor the position of the sheer shade material 22 so that the motor drive unit 15 knows the position of the sheer shade material 22 relative to certain limits associated with the sheer shade material 22 at any given time. The motor drive unit 15 may be locally controlled (e.g., with a push button on the motor drive unit 15) and/or remotely controlled (e.g., wirelessly controlled with an infrared (IR) or radio frequency (RF) remote control device). The motor drive unit 15 may further include an RF transceiver or receiver, and an antenna that may be enclosed within the housing 14 or coupled to an exterior portion of the housing 14. Examples of motor drive units for motorized roller shades are described in greater detail in U.S. Pat. No. 6,983,783, issued Jan. 10, 2006, entitled "Motorized Shade Control System," U.S. Pat. No. 7,723,939, issued May 25, 2010, entitled "Radio-Frequency Controlled Motorized Roller Shade," and U.S. Pat. No. 7,839,109, issued Nov. 23, 2010, entitled "Method Of Controlling A Motorized Window Treatment," the entire contents of each of which are incorporated herein by reference. It should be appreciated that any motor drive unit or drive system may be used to control the roller tube 18.

With continued reference to FIG. 1B, the motorized sheer shading system 10 may further include a first adjustment mechanism 50*a* that couples a first end 18*a* of the roller tube 18 to the first housing bracket 14*a* of the housing 14, and a second adjustment mechanism 50*b* that couples a second end 18*b* of the roller tube 18 to the second housing bracket 14*b* of the housing 14. The first and second adjustment mechanisms 50*a*, 50*b* may be configured such that the roller tube 18 may be adjusted along the transverse direction T relative to the housing 14, for example after the motorized sheer shading system 10 has been mounted adjacent to an opening. For example, the first end 18*a* of the roller tube 18 may be adjusted via the first adjustment mechanism 50*a*, and the second end 18*b* of the roller tube 18 may be adjusted via the second adjustment mechanism 50*b*. The first and second ends 18*a*, 18*b* of the roller tube 18 may be adjusted independently via the first and second adjustment mechanisms 50*a*, 50*b*, respectively. In this regard, the position of the bottom bar 24 may be adjusted without changing one or more control limits of the motorized sheer shading system 10. For example, one or both of the first and second adjustment mechanisms 50*a*, 50*b* may be operated to level the bottom bar 24, and/or to move the position of the bottom bar 24 relative to a floor, an opening sill, or other reference object, for instance when the sheer shade material 22 is in the closed position. Furthermore, the bottom bar 24 may be repositioned when the sheer shade material 22 is in the closed position, without removing and/or remounting components of the housing 14.

The illustrated first and second adjustment mechanisms 50*a*, 50*b* are coupled to respective idlers 60 that are configured to attach to the first and second ends 18*a*, 18*b* of the roller tube 18. It should be appreciated, however, that the idlers 60 and the first and second adjustment mechanisms 50*a*, 50*b* may be monolithic, such that the first and second adjustment mechanisms 50*a*, 50*b* may be directly coupled to the roller tube 18.

As shown in FIG. 1B, the first and second adjustment mechanisms 50*a*, 50*b* include first and second sliding members 54*a*, 54*b*, respectively, and first and second activation members 58*a*, 58*b*, respectively, that are coupled to the first and second sliding members 54*a*, 54*b*. As shown in FIG. 1B the first sliding member 54*a* is slidably coupled to the first housing bracket 14*a* of the housing 14 and operatively attached to the first end 18*a* of the roller tube 18 via a first idler 60, and the second sliding member 54*b* is slidably coupled to the second housing bracket 14*b* of the housing 14 and operatively attached to the second end 18*b* of the roller tube 18 via a second idler 60. The first activation member 58*a* is in communication with the first sliding member 54*a* (e.g., operatively), and the second activation member 58*b* is in communication with the second sliding member 54*b* (e.g., operatively). As shown, the first and second sliding members 54*a*, 54*b* and the first and second activation members 58*a*, 58*b* are configured such that rotation of the first activation member 58*a* causes the first sliding member 54*a*, and thereby the first end 18*a* of the roller tube 18, to move along the transverse direction T relative to the first housing bracket 14*a* of the housing 14, and rotation of the second activation member 58*b* causes the second sliding member 54*b*, and thereby the second end 18*b* of the roller tube 18, to move along the transverse direction T relative to the second housing bracket 14*b* of the housing 14. It should be appreciated, however, that the sliding members 54 and the activation members 58 may be configured such that motions other than rotation cause the sliding members 54 to move. For example, the activation members 58 may be configured such that when a force is applied to the activation members 58, interference between the sliding members 54 and the housing 14 and/or the activation members 58 is overcome, such that the sliding members 54 may move.

Referring now to FIGS. 2A-2C and FIG. 3, the first and second sliding members 54*a*, 54*b* each include a sliding member body 62, a pair of retention members 66 that extend from the sliding member body 62, and a guide channel 70 that extends through the sliding member body 62 along the transverse direction T, between the retention members 66. The retention members 66 of the first and second sliding members 54*a*, 54*b* may be configured to mate with respective retention members defined by the first and second housing brackets 14*a*, 14*b* of the housing 14, such that the sliding members 54 are translatable along the transverse direction T. As shown, the retention members 66 of the first and second sliding members 54*a*, 54*b* are protrusions 74 that extend away from each other along the lateral direction A from opposed sides of the sliding member bodies 62. It should be appreciated, however, that the retention members 66 may have any configuration. For example, the retention members 66 may define recesses configured to receive complementary protrusions of the first and second housing brackets 14*a*, 14*b*.

Figure 3:
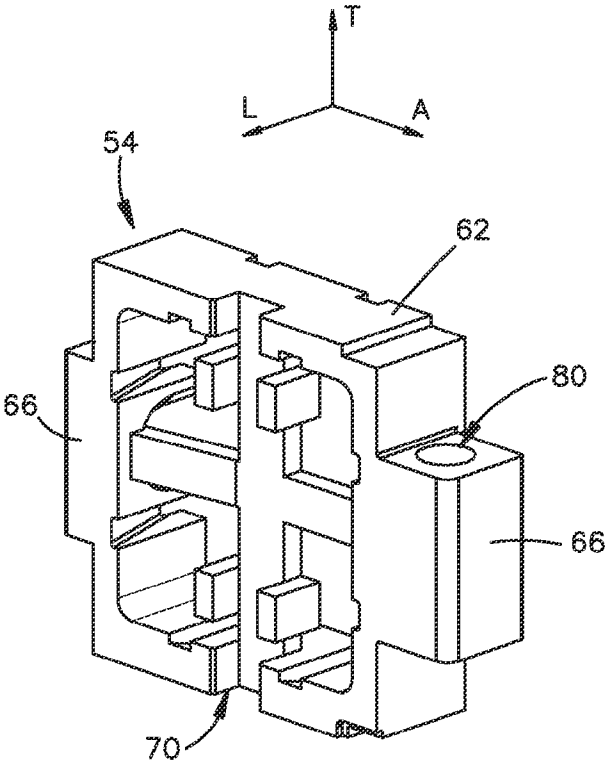
FIG. 3 is a perspective view of a sliding member component of the example adjustment mechanism component depicted in FIG. 2A.

As shown in FIG. 3, the first and second sliding members 54*a*, 54*b* each further define a threaded bore 80 that extends through one of the protrusions 74 along the transverse direction T. The threaded bores 80 may be configured to receive the activation members 58, such that rotation of the activation members 58 causes the sliding members 54 to move along the transverse direction T. It should be appreciated, however, that the threaded bores 80 may extend through any portion of the sliding members 54. For example, the threaded bores 80 may extend through the sliding member bodies 62.

Figure 2C:
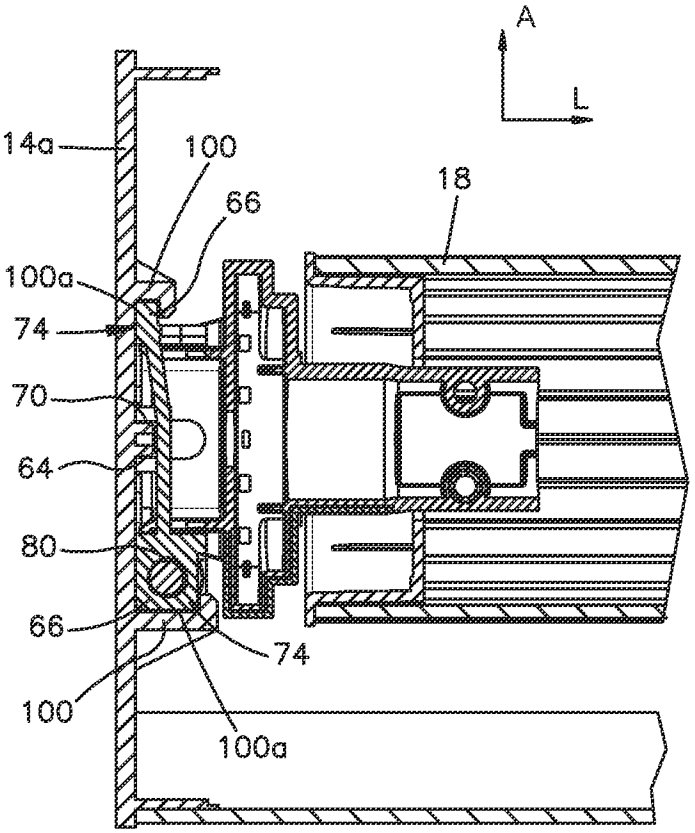
FIG. 2C depicts a cross-section example motorized sheer shading system depicted in FIG. 1A, showing components of the example adjustment mechanism component depicted in FIG. 2A.
Figure 2A:
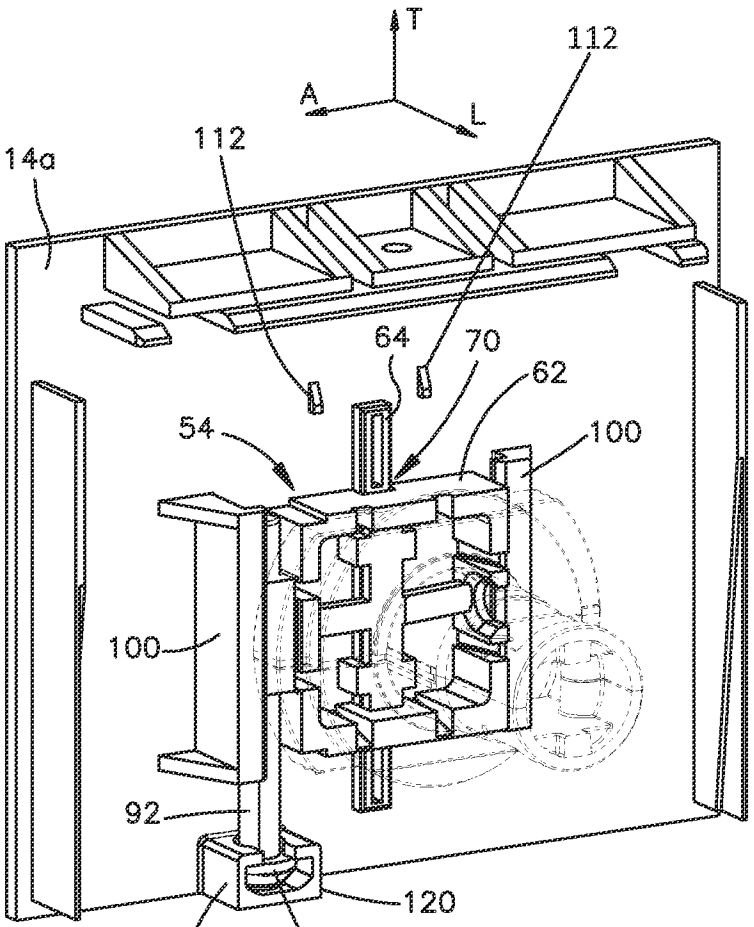
FIG. 2A is a perspective view of an example adjustment mechanism component of the example motorized sheer shading system depicted in FIG. 1A.
Figure 2B:
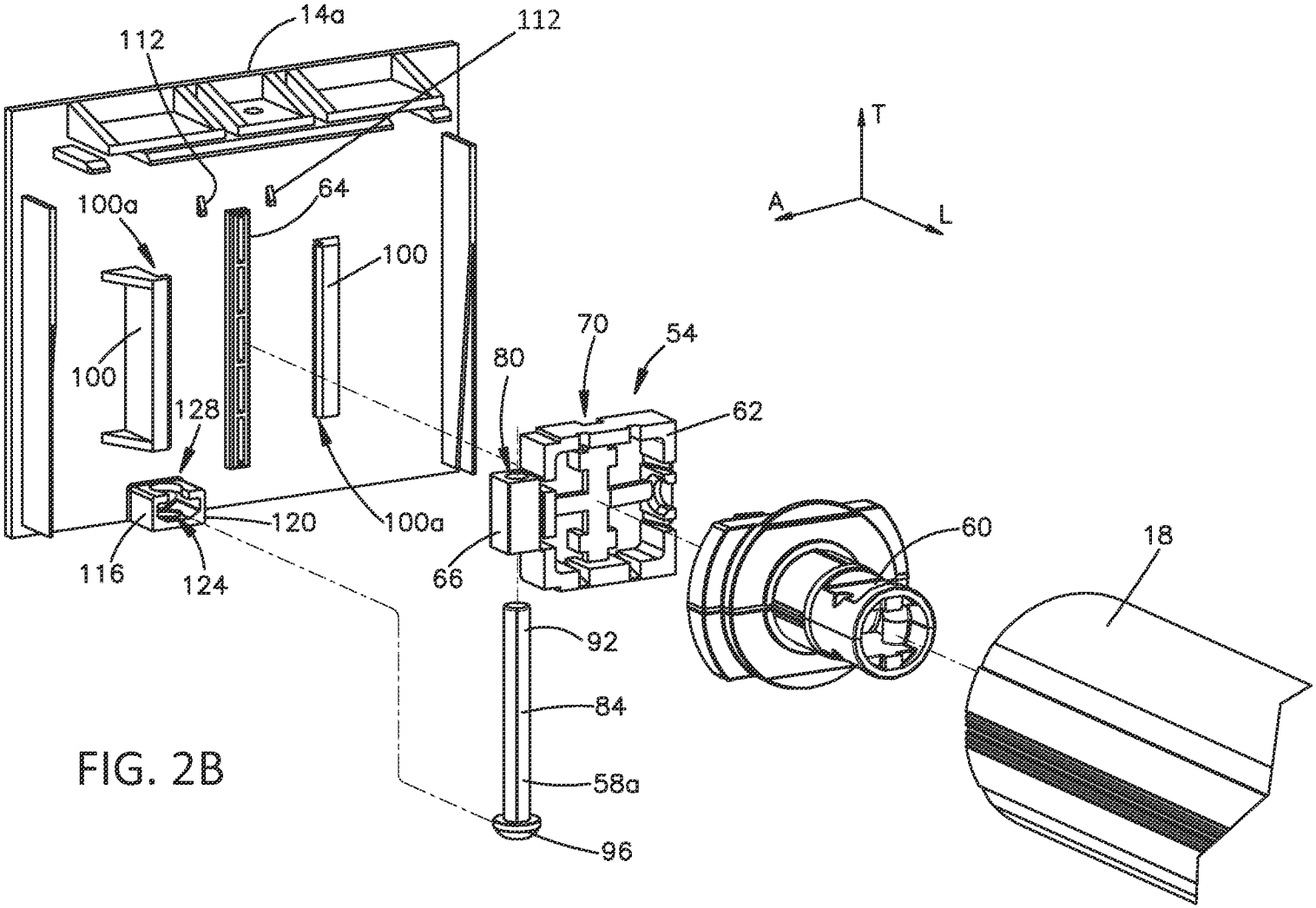
FIG. 2B is an exploded view depicting components of the example adjustment mechanism component depicted in FIG. 2A.

As shown in FIG. 2B, the first and second activation members 58*a*, 58*b* may each comprise a threaded bolt 84 that extends through a respective threaded bore 80. In particular, each bolt 84 may include a threaded shaft 92 and a head 96 that extends from the threaded shaft 92. The threaded shafts 92 may extend through the threaded bores 80 such that the threads of the shafts 92 mate with complementary threads defined by the threaded bores 80. As shown in FIG. 2A, the bolts 84 may be translatably fixed such that rotation of the bolts 84 causes the sliding members 54 to translate relative to the housing 14 and along the threaded shafts 92 of the bolts 84. It should be appreciated, however, that the activation members 58 may have any configuration. For example, the activation members may be configured as ratchets that engage teeth.

Referring now to FIGS. 1B and 2A-2C, the first and second housing brackets 14*a*, 14*b* of the housing 14 may each define a rail 64 that protrudes into the cavity 16, and that is elongate along the transverse direction T. As shown in FIGS. 2A and 2B, the guide channels 70 of the sliding members 54 may receive the rails 64 such that the sliding members 54 are configured to translate along the rails 64 upon rotation of the activation members 58.

As shown in FIG. 1B, the first and second housing brackets 14*a*, 14*b* of the housing 14 may each further define a respective pair of retention members 100 that are spaced from each other along the lateral direction A (also see FIG. 2B). The retention members 100 of the first and second housing brackets 14*a*, 14*b* may be configured to capture the first and second sliding members 54*a*, 54*b*, respectively, such that the first and second sliding members 54*a*, 54*b* are translatable along the transverse direction T. For example, as shown in FIG. 2B, each retention member 100 may define a respective recess 100*a* that is elongate along the transverse direction T, and that is configured to receive a respective protrusion 74 of a corresponding one of the sliding members 54, such that the sliding member 54 is captured in the recesses 100*a* of a corresponding pair of retention members 100 and slidably translatable in the recesses 100*a*. It should be appreciated, however, that the retention members 100 may have other configurations. For example, the retention members 100 may define protrusions configured to be received in complementary recesses of the sliding members 54.

Referring now to FIGS. 2A and 2B, the first and second housing brackets 14*a* and 14*b* of the housing 14 may each further define one or more upper stops 112 and a lower stop 116 that is spaced from the one or more upper stops 112 along the transverse direction T. The upper and lower stops 112, 116 of each of the first and second housing brackets 14*a*, 14*b* may be configured to limit translation of a respective one of the sliding members 54 along the transverse direction T. As shown in FIGS. 2A and 2B, each lower stop 116 may include a body 120 that defines a cavity 124 and a bore 128 that extends into the cavity 124 along the transverse direction T. Each cavity 124 may be sized to receive and retain the head 96 of a corresponding one of the bolts 84, such that the threaded shaft 92 of each bolt 84 extends through a corresponding bore 128 and into the threaded bore 80 of a corresponding sliding member 54. The cavity 124 of each lower stop 116 retains the head 96 of a corresponding bolt 84, such that the bolt 84 remains translatably fixed, such that rotation of the bolt 84 causes a corresponding one of the sliding members 54 to move along the threaded shaft 92 of the bolt 84.

As shown, the lower stops 116 are located generally below one of the retention members 100 of the first and second housing brackets 14*a*, 14*b*, and provide lower limits of travel for the sliding members 54. It should be appreciated, however, that the lower stops 116 may be separate from the structure that retains the bolts 84. For example, the lower stops 116 may be configured similarly as the upper stops 112 and the first and second housing brackets 14*a*, 14*b* may include an additional protrusion that defines the cavity 124.

Figure 4A:
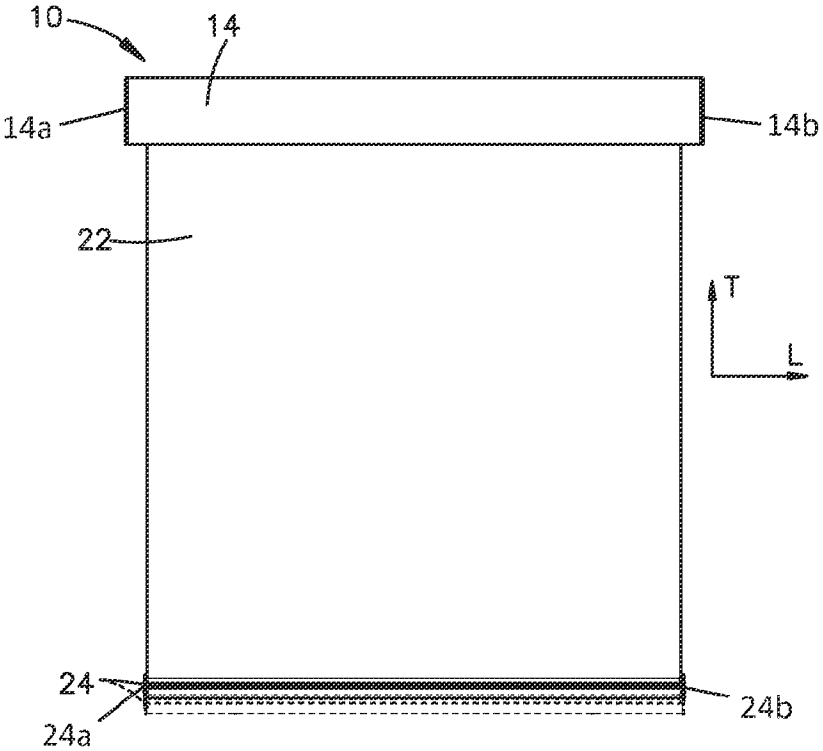
FIG. 4A is a front elevation view of the example motorized sheer shading system depicted in FIG. 1A, illustrating adjustment of the roller tube relative to the housing, to thereby adjust the position of the bottom bar.
Figure 4B:
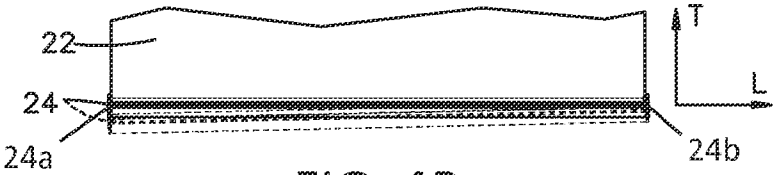
FIG. 4B is a front elevation view of the example motorized sheer shading system depicted in FIG. 1A, illustrating adjustment of the roller tube relative to the housing, to thereby adjust the position of the bottom bar.

Referring now to FIGS. 4A and 4B, the motorized sheer shading system 10 may by mounted adjacent an opening. In operation, the sheer shade material 22 may be moved to the closed position. If the bottom bar 24 is not properly positioned (e.g., unleveled or not properly spaced from a floor, window sill, or other structure) when the sheer shade material 22 is in the closed position, the positions of one or both of the first and second ends 18*a*, 18*b* of the roller tube 18 may be adjusted along the transverse direction T, relative to the housing 14, rather than changing a control limit of the sheer shade material 22 and/or remounting the motorized sheer shading system 10. To illustrate, the first activation member 58*a* may be activated to thereby cause the first end 18*a* of the roller tube 18 to move along the transverse direction T relative to the first housing bracket 14*a*, so as to adjust the position of a first end 24*a* of the bottom bar 24 along the transverse direction T. The second activation member 58*b* may be activated to thereby cause the second end 18*b* of the roller tube 18 to move along the transverse direction T relative to the second housing bracket 14*b*, so as to adjust the position of a second end 24*b* of the bottom bar 24 along the transverse direction T. In particular, a rotational force may be applied to the first and second activation members 58*a*, 58*b* to thereby cause the first and second sliding members 54*a*, 54*b* and thus the first and second ends 18*a*, 18*b* of the roller tube 18 along the transverse direction T. Accordingly, the positions of one or both of the first and second ends 24*a*, 24*b* of the bottom bar 24 may be adjusted along the transverse direction T, for example to ensure that the bottom bar 24 is level (e.g., parallel to a window sill, a floor below an opening, or other structure), as shown in FIG. 4B, and/or to minimize a light gap between the bottom bar and a window sill below the opening, as shown in FIG. 4A.

It should be appreciated that while the first and second adjustment mechanisms 50*a*, 50*b* are illustrated as being incorporated into the motorized sheer shading system 10, that the first and second adjustment mechanisms 50*a*, 50*b* may be incorporated into any shade system. For example, the first and second adjustment mechanisms 50*a*, 50*b* may be incorporated into a double roller shade system and/or a single roller shade system. Stated differently, the first and second adjustment mechanisms 50*a*, 50*b* may be configured to adjust any type of roller tube that is configured move any type of shade.

Referring now to FIGS. 5A and 5B, the bottom bar 24 may be elongate along the longitudinal direction L, and may be attached to the sheer shade material 22, opposite the roller tube 18, such that the bottom bar 24 has a first position when the sheer shade material 22 is in the closed position (e.g., as shown in FIG. 5A) and a second position when the sheer shade material 22 is in the view position (e.g., as shown in FIG. 5B). As shown in FIG. 5A, the bottom bar 24 defines a cross-sectional profile such that when the bottom bar 24 is in the first position, the bottom bar 24 defines a first lower most edge 130 that is elongate along the longitudinal direction L, and that is spaced from the roller tube 18 by a first distance D1. As shown in FIG. 5B, the bottom bar 24 defines a cross-sectional profile such that when the bottom bar 24 is in the second position, the bottom bar 24 defines a second lower most edge 134 that is elongate along the longitudinal direction L, and that is spaced from the roller tube 18 by a second distance D2 that is substantially equal to the first distance D1. Substantially, in this case, means within about 5 mm. It should be appreciated, however, that the second distance D2 may be within 2 mm of the first distance D1, and is preferably equal to the first distance D1. When the bottom bar 24 is moved from the first position (e.g., when the sheer shade material 22 is in the closed position) to the second position (e.g., when the sheer shade material 22 is in the view position), a distance measured along the transverse direction T between the corresponding lower most edge of the bottom bar 24 (e.g., 130 or 134) and a window sill, a floor below an opening, or other structure, remains substantially constant. When the sheer shade material 22 is moved to an intermediate position that is between the closed position and the view position, the bottom bar 24 may be moved to a third position, wherein a distance measured along the transverse direction T between the lower most edge of the bottom bar 24 and a window sill, a floor below the opening, or other structure, remains substantially constant as the bottom bar 24 is moved between the first, second, and third positions.

With continued reference to FIGS. 5A and 5B, the bottom bar 24 may define a bottom surface 150 that is at least partially curved along the lateral direction A, so as to define at least one curved surface 154. The curved surface 154 may define a radius r, such that a distance between the lower most edge of the bottom bar 24 and the roller tube 18 remains substantially constant as the bottom bar 24 is moved between the first and second positions. For example, the radius r and the height of the bottom bar 24 (e.g., the distance from the top of the bottom bar to the bottom of the bottom bar as viewed in FIG. 5B) may be dependent upon the width of the bottom bar 24 (e.g., the distance from side to side as viewed in FIG. 5B) and the movement of the first and second sheer fabrics 32, 36 as the bottom bar 24 rotates from the closed position to the view position, and vice versa. The movement of the first and second sheer fabrics 32, 36 as the bottom bar 24 rotates may be dependent upon a radius of the roller tube 18 and a width of the sheer shade material 22 (e.g., the distance between the first and second sheer fabrics 32, 36 as shown in FIG. 1C). Accordingly, different sheer fabric materials may be associated with distinct radii r of the bottom bar 24. To illustrate, an example bottom bar 24 may include the following dimensions: width=1.690 inches; height=0.720 inches; and radius r=1.500 inches. It should be appreciated, however, that the bottom bar 24 may have any dimensions, and that the curved surface 154 may have any radius.

As shown in FIG. 5B, the bottom surface 150 may define a concave portion 158 and a convex portion 162 that is adjacent the concave portion 158 along the lateral direction A. The convex portion 162 may define the curved surface 154, and may be configured to bias the sheer shade material 22 toward the closed position. That is, the convex portion 162 may have a weight that is greater than the concave portion 158, such that the bottom bar 24 will tend to rotate in a particular direction. It should be appreciated, however, that the bottom bar 24 may have other configurations. For example, the bottom surface 150 of the bottom bar 24 may be void of the concave portion 158.

It should be appreciated that the example adjustment mechanisms illustrated and described herein are not limited to use with motorized window treatments having sheer shade material coverings, and that the example adjustment mechanisms may be integrated into motorized window treatments having other types of shade assemblies and/or shades. For instance, the example adjustment mechanisms illustrated and described herein may be integrated into motorized window treatments having roller shades, honeycomb shades, cellular shades, pleated shades, roman shades, venetian blinds, draperies, or the like.

The invention claimed is:

1. A motorized shade system comprising:

a housing that is elongate along a first direction, the housing includes a first housing bracket that has a first rail and a second housing bracket that has a second rail;

a first adjustment mechanism that includes a first sliding member that defines a first threaded bore, a first pair of protrusions, and a first guide channel, wherein the first guide channel receives the first rail such that the first sliding member is translatable along the first rail, the first adjustment mechanism further including a first activation member that extends through the first threaded bore such that rotation of the first activation member causes the first sliding member to translate along the first rail;

a second adjustment mechanism that includes a second sliding member that defines a second threaded bore, a second pair of protrusions, and a second guide channel, wherein the second guide channel receives the second rail such that the second sliding member is translatable along the second rail, the second adjustment mechanism further including a second activation member that extends through the second threaded bore such that rotation of the second activation member causes the second sliding member to translate along the second rail;

a roller tube that is rotatably mounted to the housing, the roller tube defining a first end that is attached to the first sliding member and a second end that is attached to the second sliding member; and a covering material that is windingly attached to the roller tube such that rotation of the roller tube causes the covering material to move along a second direction that is normal to the first direction, wherein translation of the first sliding member along the first rail causes the first end of the roller tube to move relative to the first housing bracket, and translation of the second sliding member along the second rail causes the second end of the roller tube to move relative to the second housing bracket, and wherein the first housing bracket defines a first pair of recesses that are spaced from each other and that are configured to capture the first pair of protrusions and the second housing bracket defines a second pair of recesses that are spaced from each other and that are configured to capture the second pair of protrusions.

2. The motorized shade system of claim 1, wherein the first activation member includes a first threaded shaft and a first head, and the first housing bracket includes a first lower stop that limits translation of the first sliding member and that is configured to translatably fix the first head, and wherein the second activation member includes a second threaded shaft and a second head, and the second housing bracket includes a second lower stop that limits translation of the second sliding member and that that is configured to translatably fix the second head.

3. The motorized shade system of claim 2, wherein the first housing bracket defines a first upper stop that is spaced from the first lower stop and that further limits translation of the first sliding member, and the second housing bracket defines a second upper stop that is spaced from the second lower stop and that further limits translation of the second sliding member.

4. The motorized shade system of claim 1, wherein the covering material is a sheer shade material that includes a first sheer fabric, a second sheer fabric, and a plurality of vanes that extend between the first and second sheer fabrics.

5. The motorized shade system of claim 4, further comprising a motor that is operatively coupled to the roller tube such that the motor is configured to move the sheer shade material between an open position wherein the sheer shade material is wound about the roller tube, a closed position wherein the sheer shade material covers an opening and visualization through the sheer shade material is impeded, and a view position wherein the sheer shade material covers the opening and visualization through the sheer shade material is permitted.

6. The motorized shade system of claim 5, further comprising a bottom bar that is attached to the sheer shade material, the bottom bar defines a cross-sectional profile such that:

when the sheer shade material is in the closed position, the bottom bar assumes a first position wherein a first lower most edge of the bottom bar is spaced from the roller tube by a first distance; and when the sheer shade material is in the view position, the bottom bar assumes a second position wherein a second lower most edge of the bottom bar is spaced from the roller tube by a second distance that is substantially equal to the first distance.

7. A motorized sheer shading system, the motorized sheer shading system comprising:

a housing that extends from a first end to a second end along a first direction, the housing defining a first rail at the first end and a second rail at the second end;

a roller tube that is rotatably mounted to the housing, the roller tube defining a first end and an opposed second that is spaced from the first end along the first direction;

a sheer shade material that includes a first sheer fabric, a second sheer fabric, and a plurality of vanes that extend between the first and second sheer fabrics, wherein the sheer shade material is windingly attached to the roller tube such that the sheer shade material is movable along a second direction that is normal to the first direction;

a motor that is operatively coupled to the roller tube and that is configured to move the sheer shade material between an open position wherein the sheer shade material is wound about the roller tube, a closed position wherein visualization through the sheer shade material is impeded, and an open position wherein visualization through the sheer shade material is permitted;

a first adjustment mechanism that couples the first end of the roller tube to the first end of the housing, the first adjustment mechanism including a first sliding member that defines a first threaded bore, a first pair of protrusions, and a first guide channel that is configured to receive and slide along the first rail, the first adjustment mechanism further including a first activation member that extends through the first threaded bore; and a second adjustment mechanism that couples the second end of the roller tube to the second end of the housing, the second adjustment mechanism including a second sliding member that defines a second threaded bore, a second pair of protrusions, and a second guide channel that is configured to receive and slide along the second rail, the second adjustment mechanism further including a second activation member that extends through the second threaded bore;

wherein the housing further defines a first pair of recesses at the first end that are configured to capture the first pair of protrusions and a second pair of recesses at the second end that are configured to capture the second pair of protrusions, and wherein rotation of the first activation member causes the first sliding member to translate along the first rail, thereby causing the first end of the roller tube to move along the second direction relative to the housing, and rotation of the second activation member causes the second sliding member to translate along the second rail, thereby causing the second end of the roller tube to move along the second direction relative to the housing.

8. The motorized sheer shading system of claim 7, wherein the housing includes a first housing bracket that is attached to the first end of the housing, the first housing bracket defining the first rail, and wherein the housing includes a second housing bracket that is attached to the second end of the housing, the second housing bracket defining the second rail.

9. The motorized sheer shading system of claim 8, wherein the first housing bracket is configured to translatably fix the first activation member relative to the first end of the housing, and wherein the second housing bracket is configured to translatably fix the second activation member relative to the second end of the housing.

10. The motorized sheer shading system of claim 8, wherein the first housing bracket defines first opposed upper and lower stops that are configured to limit translation of the first sliding member, and wherein the second housing bracket defines second opposed upper and lower stops that are configured to limit translation of the second sliding member.

11. A motorized sheer shading system comprising:

a housing that extends from a first end to a second end along a first direction, the housing defining a first rail at the first end and a second rail at the second end;

a roller tube that is elongate along the first direction;

a sheer shade material that is windingly attached to the roller tube, the sheer shade material includes a first sheer fabric, a second sheer fabric, and a plurality of vanes that extend between the first and second sheer fabrics;

a motor that is configured to rotate the roller tube so as to move the sheer shade material between an open position, a closed position, and a view position;

a first adjustment mechanism that couples a first end of the roller tube to the first end of the housing, the first adjustment mechanism including a first sliding member that defines a first threaded bore, a first pair of protrusions, and a first guide channel that is configured to receive the first rail, the first adjustment mechanism further including a first activation member that extends through the first threaded bore, wherein rotation of the first activation member causes the first sliding member to translate along the first rail;

a second adjustment mechanism that couples a second end of the roller tube to the second end of the housing, the second adjustment mechanism including a second sliding member that defines a second threaded bore, a second pair of protrusions, and a second guide channel that is configured to receive the second rail, the second adjustment mechanism further including a second activation member that extends through the second threaded bore, wherein rotation of the second activation member causes the second sliding member to translate along the second rail; and a bottom bar that is elongate along the first direction and that is attached to the sheer shade material, wherein when the sheer shade material is in the closed position, the bottom bar defines a first lower most edge that is elongate along the first direction and that is spaced from the roller tube by a first distance, and wherein when the sheer shade material is in the view position, the bottom bar defines a second lower most edge that is elongate along the first direction and that is spaced from the roller tube by a second distance that is substantially equal to the first distance, and wherein the housing further defines a first pair of recesses at the first end that are configured to capture the first pair of protrusions and a second pair of recesses at the second end that are configured to capture the second pair of protrusions.

12. The sheer shading system of claim 11, wherein when the sheer shade material is in an intermediate position that is between the closed position and the view position, the bottom bar defines a third lower most edge that is elongate along the first direction and is spaced from the roller tube by a third distance that is substantially equal to both the first distance and the second distance.

13. The sheer shading system of claim 11, wherein the second distance is within 2 mm of the first distance.

14. The sheer shading system of claim 11, wherein the second distance is equal to the first distance.

* * * * *